US010250971B1

(12) United States Patent
Qin et al.

(10) Patent No.: US 10,250,971 B1
(45) Date of Patent: Apr. 2, 2019

(54) SPEAKER BOX

(71) Applicant: AAC Technologies Pte. Ltd., Singapore (SG)

(72) Inventors: Peng Qin, Shenzhen (CN); Wei Wei, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 16/056,661

(22) Filed: Aug. 7, 2018

(30) Foreign Application Priority Data

Nov. 2, 2017 (CN) ..... 2017 2 1452164 U

(51) Int. Cl.
*H04R 1/02* (2006.01)
*H04R 1/28* (2006.01)
*H04R 7/12* (2006.01)

(52) U.S. Cl.
CPC ..... *H04R 1/288* (2013.01); *H04R 1/023* (2013.01); *H04R 1/025* (2013.01); *H04R 7/127* (2013.01); *H04R 2499/11* (2013.01)

(58) Field of Classification Search
CPC ..... H04R 1/288; H04R 1/023; H04R 1/025; H04R 7/127; H04R 2499/11
See application file for complete search history.

(56) References Cited

U.S. PATENT DOCUMENTS

2013/0315434 A1* 11/2013 Fujiwara ..... H04R 9/046 381/409
2018/0192217 A1* 7/2018 Hogan ..... H04R 29/003
2018/0213319 A1* 7/2018 Qin ..... H04R 1/2857

* cited by examiner

*Primary Examiner* — Andrew L Sniezek
(74) *Attorney, Agent, or Firm* — Na Xu; IPro, PLLC

(57) ABSTRACT

The present application discloses a speaker box. The speaker box includes a lower cover; an upper cover engaging with the lower cover for forming an accommodating space; a speaker accommodated in the accommodating space, and including a diaphragm with a dome attached to the diaphragm; a front sound cavity formed by the diaphragm and the upper cover; an air adsorbent plate attached to the dome; and an auxiliary film attached to the dome. The dome forms a through-hole communicating with the front sound cavity, and the air adsorbent plate strides over the through-hole, while the auxiliary film covers the through-hole on another surface of the dome.

6 Claims, 3 Drawing Sheets

SPEAKER BOX

FIELD OF THE PRESENT DISCLOSURE

This disclosure related to the field of electro-acoustic transducers, and more particularly to a speaker box used in a portable electronic device, like a mobile phone.

DESCRIPTION OF RELATED ART

A mobile phone is more and more popular in day life. As one important feature of a mobile phone, music play-back is one of the concerns for a user to choose a phone. A speaker box is a component, or a transducer to convert electrical signals to audible sounds (music).

A related speaker box used in a mobile phone includes a housing and a speaker received in the housing. Generally, the speaker includes a diaphragm for radiating sounds, and a front sound cavity formed between the diaphragm and the housing. For transmitting sounds outside, the speaker box further includes a sound passageway communicating the front cavity and the outside. The front sound cavity and the sound passageway cooperatively form a front cavity. However the inner sides of the sound cavity are smooth and provide little damping. Further, the front cavity will produce resonance during the vibration of the diaphragm, which will further produce distortion peaks. Distortion peaks will cause high-frequency noises and distortion of sounds. Acoustic performance is accordingly lowered.

Therefore it is necessary to provide an improved speaker box for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
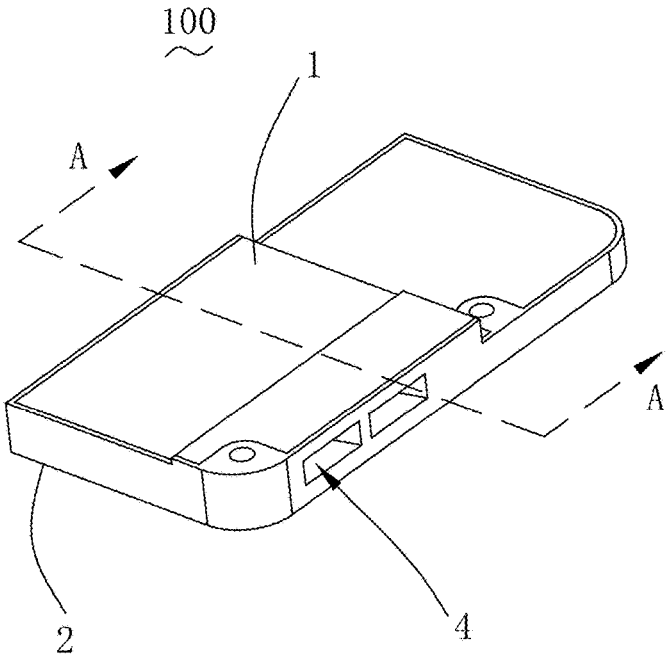
FIG. 1 is an isometric view of a speaker box in accordance with an exemplary embodiment of the present invention.
Figure 2:
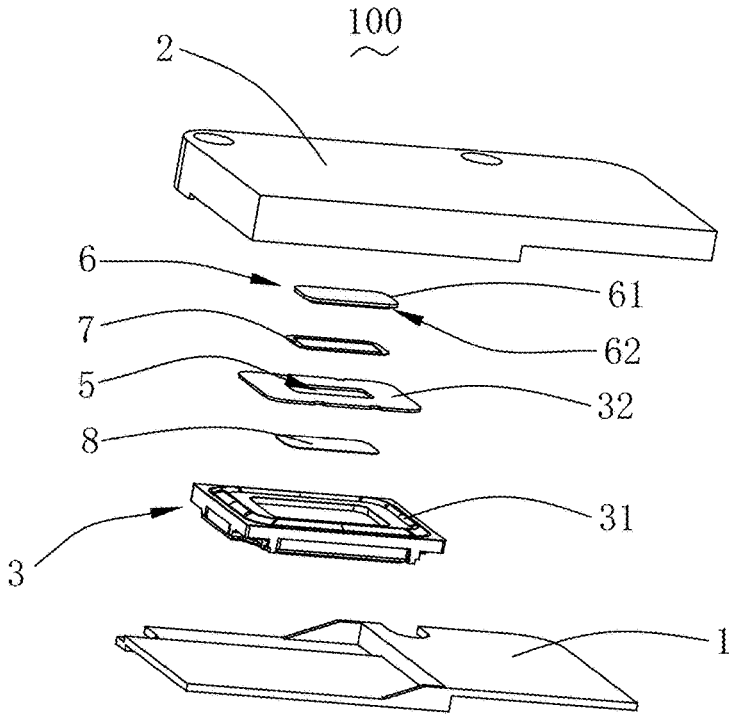
FIG. 2 is an exploded view of the speaker box in FIG. 1.
Figure 3:
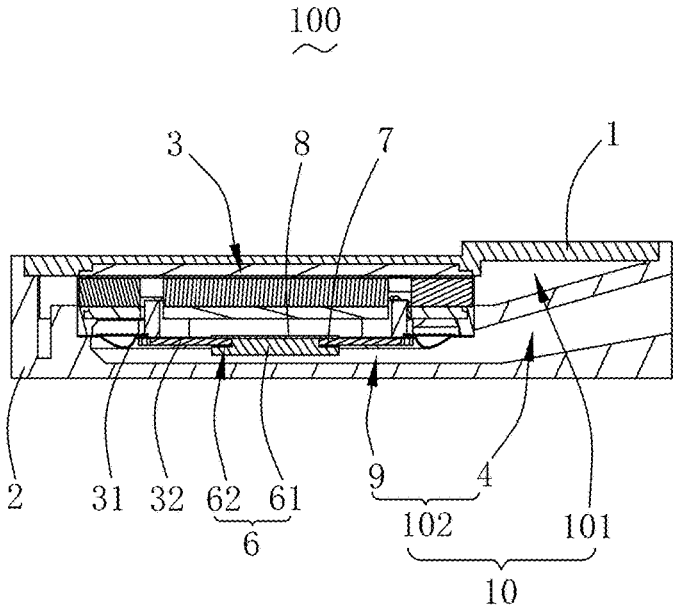
FIG. 3 is a cross-sectional view of the speaker box in FIG. 1, taken along line A-A.

Referring to FIGS. 1-3, a speaker box 100, in accordance with an exemplary embodiment of the present disclosure, includes a lower cover 1, an upper cover 2 engaging with the lower cover 1, a speaker 3, a sound passageway 4, a through-hole 5, an air adsorbent plate 6, an adhesive layer 7, and an auxiliary film 8. The lower cover 1 and the upper cover 2 cooperatively form an accommodating space 10. The speaker 3 is accommodated in the accommodating space 10.

The speaker 3 includes a diaphragm 31 for radiating sounds and a dome 32 attached to the diaphragm 31. A front sound cavity 9 is formed between the diaphragm 31 and the upper cover 2, and a rear cavity 101 is formed between the diaphragm 31 and the lower cover 1. The sound passageway 4 is formed in the accommodating space 10, and specifically, the sound passageway 4 is formed in the upper cover 2. The sound passageway 4 communicates the front sound cavity 9 with the outside of the speaker box 100.

In this embodiment, the speaker 3 divides the accommodating space 100 into a front cavity 102 and the rear cavity 101. The front cavity 102 is formed by the sound passageway 4 and the front sound cavity 9. The rear cavity 101 is used for enhancing low-frequency performance.

The air adsorbent plate 6 is received in the front sound cavity 8 and positioned on the dome 32 of the speaker 3. When the dome 32 vibrates at high frequency, high frequency harmonic and noises are produced. Such harmonic and noises will be amplified resonantly. By virtue of the air adsorbent plate 6, the high frequency harmonic and noises will be adsorbed by the air adsorbent plate 6, which effectively improve the acoustic performance of the speaker box 100.

In the exemplary embodiment, the through-hole 5 is formed in the dome 32 communicating with the front sound cavity 9 for positioning the air adsorbent plate 6. The air adsorbent plate 6 completely covers the through-hole 5 and is firmly attached to the dome 32 by the adhesive layer 7.

The air adsorbent plate 6 make the inner sides of the front sound cavity 9 rough, which increases the damping of the front sound cavity 9 and reduces distortion peaks of the speaker box 100. And accordingly, high-frequency noises and harmonic distortions are restrained. As a result, the acoustic performance of the speaker box 100 is improved.

The air adsorbent plate 6, in this embodiment, includes a main body 61 and a step 62 extending from the main body 61. The main body 61 has a diameter not greater than a diameter of the through-hole 5 for being completely received in the through-hole 5, and the step 62 strides over the through-hole 5 for restricting the position of the air adsorbent plate 6.

The air adsorbent plate 6 is made of nanoscale porous particle polymerizations. Preferably, the diameter of the nanoscale porous particle polymerization is less than 100 um.

In addition, by virtue of the air adsorbent plate 6 engaging with the through-hole 5, there's no need to form additional leakage passage in the rear cavity 101.

The adhesive layer 7 is sandwiched between the step 62 and the dome 32 for attaching the adsorbent plate 6 onto the dome 32. The adhesive layer 7 seals the through-hole 5. It should be noted that the adsorbent plate 6 could be attached to the dome by the adhesive layer, and also could be connected to the dome by other means, e.g., mechanically connection.

The auxiliary film 8 covers the through-hole 5 and attaches to a surface of the dome 32 away from the upper cover 2. In the embodiment, the auxiliary film 8 attaches to one of the surfaces of the dome, and the step 62 attaches to another surface of the dome opposite to the surface where the auxiliary film locates. The auxiliary film 8 is an air impermeable film used for preventing air (sound waves) from entering the rear cavity 101, and further for preventing the rear cavity 101 from forming acoustic short-circuit with the front cavity 102, by which the stability and acoustic performance of the speaker box 100 are accordingly improved.

Figure 4:
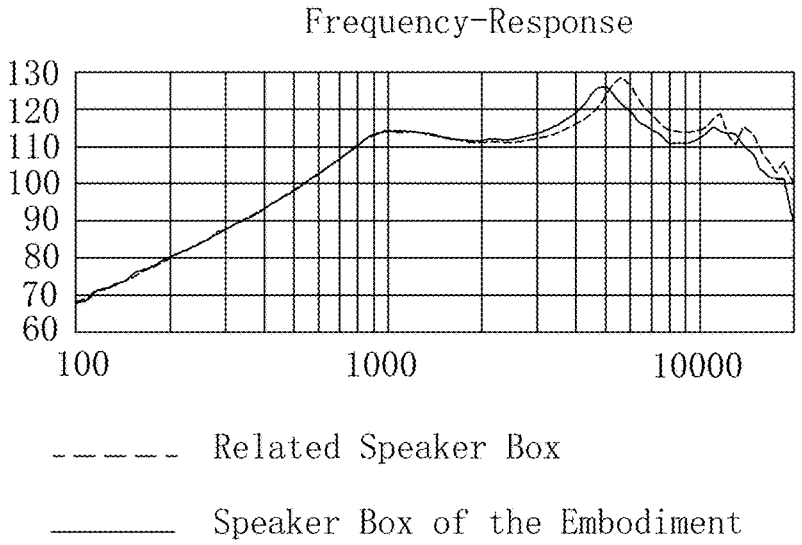
FIG. 4 shows frequency-response curves of the speaker box of the exemplary embodiment and the related speaker box.
Figure 5:
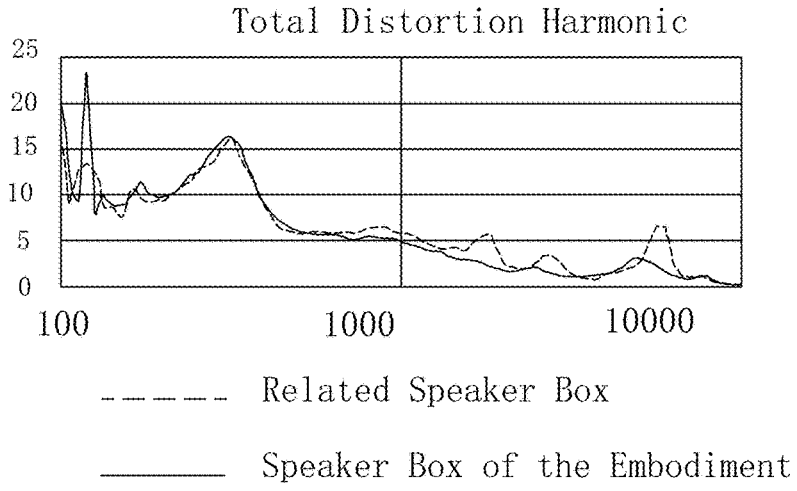
FIG. 5 shows total harmonic distortion curves of the speaker box of the invention and the related speaker box.

Referring to FIG. 4, frequency-response curves of the speaker box of the invention and related speaker box are shown. It can be seen that resonance peaks of the front cavity 102 are obviously reduced. Referring to FIG. 5, the distortion peaks of the front cavity 102 are effectively reduced.

Compared with related technologies, the air adsorbent plate 6 make the inner sides of the front sound cavity 8 rough, which increases the damping of the front sound cavity 8 and reduces distortion peaks of the speaker box 100. And accordingly, high-frequency noises and harmonic distortions are restrained. As a result, the acoustic performance of the speaker box 100 is improved. The auxiliary film 8 is an air impermeable film used for preventing air (sound waves) from entering the rear cavity 101, and further for preventing the rear cavity 101 from forming acoustic short-circuit with the front cavity 102, by which the stability and acoustic performance of the speaker box 100 are accordingly improved.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box, comprising:

a lower cover;

an upper cover engaging with the lower cover for forming an accommodating space;

a speaker accommodated in the accommodating space, and including a diaphragm with a dome attached to the diaphragm;

a front sound cavity formed by the diaphragm and the upper cover;

an air adsorbent plate received in the front sound cavity;

an auxiliary film made of air impermeable material;

wherein the dome forms a through-hole communicating with the front sound cavity, the air adsorbent plate completely covers the through-hole on a surface of the dome adjacent to the upper cover, and the auxiliary film covers the through-hole on another surface opposite to the surface where the air adsorbent plate locates.

2. The speaker box as described in claim 1, wherein the air adsorbent plate is made of nanoscale porous particles.

3. The speaker box as described in claim 2, wherein a diameter of the nanoscale porous particle is less than 100 um.

4. The speaker box as described in claim 1, wherein the air adsorbent plate includes a main body having a diameter not greater than a diameter of the through-hole for being completely received in the through-hole, and a step striding over the through-hole.

5. The speaker box as described in claim 1 further including an adhesive layer sandwiched between the dome and the air adsorbent plate for attaching the air adsorbent plate to the dome.

6. The speaker box as described in claim 1 further including a sound passageway communicating the front sound cavity with outside, and the passageway forms a front cavity together with the front sound cavity.

* * * * *